US006174428B1

(12) United States Patent
Ambrosino et al.

(10) Patent No.: US 6,174,428 B1
(45) Date of Patent: Jan. 16, 2001

(54) PROCESS FOR CONVERTING HYDROCARBONS BY TREATMENT IN A DISTILLATION ZONE COMPRISING A CIRCULATING REFLUX, ASSOCIATED WITH A REACTION ZONE, AND ITS USE FOR HYDROGENATING BENZENE

(75) Inventors: Jean-Louis Ambrosino, Ternay; Blaise Didillon; Pierre Marache, both of Rueil Malmaison; Jean-Charles Viltard, Vienne; Gérald Witte, Viroflay, all of (FR)

(73) Assignee: Institut Francais du Petrole, Rueil Malmaison Cedex (FR)

( * ) Notice: Under 35 U.S.C. 154(b), the term of this patent shall be extended for 0 days.

(21) Appl. No.: 09/285,777

(22) Filed: Apr. 5, 1999

(30) Foreign Application Priority Data

Apr. 6, 1998 (FR) ..... 98 04352

(51) Int. Cl.[7] ..... C10G 7/00
(52) U.S. Cl. ..... 208/92; 208/133
(58) Field of Search ..... 208/133, 92

(56) References Cited

U.S. PATENT DOCUMENTS 3,926,785 12/1975 Siegel ..... 208/211
4,302,356 * 11/1981 Smith ..... 252/477
5,073,236 * 12/1991 Gelbein et al. ..... 203/29
5,362,377 * 11/1994 Marker ..... 208/133

FOREIGN PATENT DOCUMENTS 0 781 830 7/1997 (EP) .

* cited by examiner

*Primary Examiner*—Helane E. Myers
(74) *Attorney, Agent, or Firm*—Millen, White, Zelano & Branigan, P.C.

(57) ABSTRACT

The invention provides a process for converting a hydrocarbon feed in which said feed is treated in a distillation zone producing a bottom effluent and a vapour distillate, associated with an at least partially external reaction zone comprising at least one catalytic bed, in which at least one reaction for converting at least a portion of at least one hydrocarbon is carried out in the presence of a catalyst and a gas stream comprising hydrogen, the feed for the reaction zone being drawn off at the height of at least one draw-off level and representing at least a portion of the liquid flowing in the distillation zone, at least part of the effluent from the reaction zone being re-introduced into the distillation zone at the height of at least one re-introduction level, so as to ensure continuity of the distillation, and so as to withdraw a distillate from the distillation zone and to recover a bottom effluent from the bottom of the distillation zone, said process being characterized in that the temperature of the portion of effluent re-introduced into the distillation zone is lower than that of the feed to the reaction zone drawn off at the height of a draw-off level located below the re-introduction level. This process can be used to reduce the benzene content in a hydrocarbon cut.

21 Claims, 2 Drawing Sheets

Figure 1:
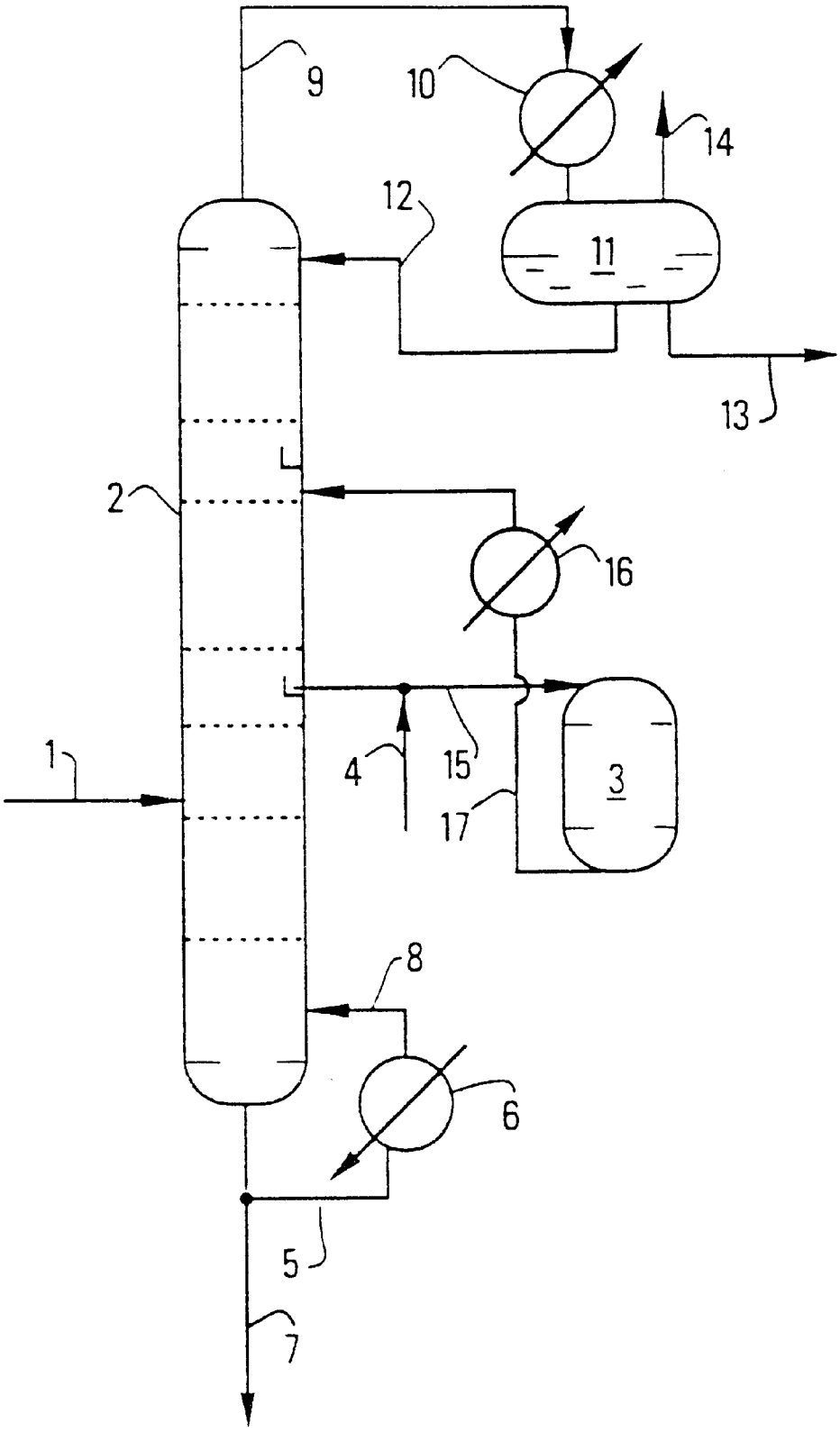

PROCESS FOR CONVERTING HYDROCARBONS BY TREATMENT IN A DISTILLATION ZONE COMPRISING A CIRCULATING REFLUX, ASSOCIATED WITH A REACTION ZONE, AND ITS USE FOR HYDROGENATING BENZENE

CROSS REFERENCE TO RELATED APPLICATION

This application is related to applicants' concurrently filed application Attorney Docket No. Pet-1747, entitled "Process For Converting Hydrocarbons By Treatment In A Distillation Zone Comprising Withdrawing A Stabilised Distillate, Associated With A Reaction Zone, And Its Use For Hydrogenating Benzene", based on French Application 98/04.351 filed Apr. 6, 1998, said applications being incorporated by reference herein.

The invention relates to a process for converting hydrocarbons. The process of the invention associates a distillation zone with a hydrocarbon conversion reaction zone which is at least partially external to the distillation zone. Thus this process can selectively convert hydrocarbons separated from a hydrocarbon feed by means of the distillation zone.

In particular, the process of the invention is applicable to selective reduction of the quantity of light unsaturated compounds (i.e., containing at most six carbon atoms per molecule) including benzene in a hydrocarbon cut essentially comprising at least 5 carbon atoms per molecule, with no substantial loss of octane number, said process comprising passing said cut into a distillation zone associated with a hydrogenation reaction zone.

BACKGROUND OF THE INVENTION

The general trend now is to reduce the quantity of benzenes and olefins (unsaturated compounds) in gasolines, because of their known toxicity.

Benzene has carcinogenic properties and thus the possibility of it polluting the air must be limited as far as possible, in particular by practically excluding it from automobile fuels. In the United States, reformulated fuels must not contain more than 1% by volume of benzene; in Europe, it has been recommended that a gradual decrease towards that value be made.

The benzene content of a gasoline is very largely dependent on that of the reformate component in that gasoline. The reformate results from catalytic treatment of naphtha intended to produce aromatic hydrocarbons, principally comprising 6 to 9 carbon atoms per molecule and the octane number of which is very high endowing the gasoline with antiknock properties.

Because of the toxicity described above, the amount of benzene in the reformate must be reduced to acceptable levels.

The benzene in a reformate can be hydrogenated to cyclohexane. Since it is impossible to selectively hydrogenate benzene in a mixture of hydrocarbons also containing toluene and xylenes, that mixture must first be fractionated to isolate a cut containing only benzene, which can then be hydrogenated.

International patent application WO 95/1 5934 describes a reactive distillation which aims to selectively hydrogenate diolefins and C2–C5 acetylenic compounds. The distillate can be separately recovered from the light compounds. The catalytic hydrogenation zone is completely internal to the distillation column, which means that the hydrogen cannot dissolve properly in the feed and the pressure cannot be increased.

A process has been described in which the catalytic benzene hydrogenation zone is internal to the distillation column has been described which separates benzene from other aromatic compounds (Benzene Reduction—Kerry Rock and Gary Gildert CDTECH—1994 Conference on Clean Air Act Implementation and Reformulated Gasoline—October 94), which cuts the cost of the apparatus. It appears that the pressure drop across the catalytic bed(s) in that process means that an intimate mixture between the liquid phase and the gaseous stream containing the hydrogen cannot be obtained. In that type of technology where the reaction and distillation proceed simultaneously in the same physical space, the liquid phase descends through every catalytic bed in the reaction zone in a trickle flow, and thus in threads of liquid. The gaseous fraction containing the fraction of vaporised feed and the gas stream containing hydrogen rise through the catalytic bed in columns of gas. In that arrangement, the entropy of the system is high and the pressure drop across the catalytic bed(s) is low. As a result, operating that type of technique cannot easily promote dissolution of hydrogen in the liquid phase comprising the unsaturated compound(s).

European published patent application EP-A-0 781 830 assigned to Institut Francais du Pétrol describes a process for hydrogenating benzene using a distillation column associated with a reaction zone which is at least partially external. The feed for the reaction zone is withdrawn from the distillation zone then the effluent from the reaction zone is re-introduced into the distillation zone. The hydrogenation reaction can also take place in the distillation zone. This process does not envisage a circulating reflux in the column with the result that no heat is extracted from the reaction zone.

SUMMARY OF THE INVENTION

The process of the present invention is an improvement over patent application EP-A-0 781 830, the features of which are hereby included in the present description.

The invention provides a process for converting a hydrocarbon feed associating a distillation zone and a reaction zone which is at least partially external to the distillation zone producing a vapour distillate and a bottom effluent. At least one reaction for converting at least a portion of at least one hydrocarbon takes place in a reaction zone comprising at least one catalytic bed, in the presence of a catalyst and a gas stream comprising hydrogen. The feed for the reaction zone is drawn off at the height of a draw-off level and represents at least a portion of the liquid flowing in the distillation zone, and at least a portion of the effluent from the reaction zone is re-introduced into the distillation zone at the height of at least one re-introduction level, so as to ensure continuity of distillation. The invention is characterized in that the temperature of the portion of the effluent from the reaction zone re-introduced into the distillation zone is lower than that of the feed for the reaction zone drawn off at the height of a draw-off level located below the re-introduction level.

The Applicant has surprisingly discovered that carrying out at least one circulation of a liquid drawn off from the distillation zone at a draw-off level and re-introduced at a re-introduction level located above said draw-off level, the temperature of said liquid at the re-introduction level being lower than the temperature of said liquid at the draw-off level, improves the performance of the process.

More particularly, the process of the present invention is applicable to hydrogenation of benzene and other unsaturated compounds in a hydrogenation zone associated with a distillation zone. In a particular application, the process of the invention is a process for treating a feed, the major portion of which is constituted by hydrocarbons containing at least 5, preferably 5 to 9, carbon atoms per molecule, and comprising at least one unsaturated compound, comprising benzene and possibly olefins in which said feed is treated in a distillation zone associated with a hydrogenation reaction zone which is at least partially external and comprises at least one catalytic bed, in which hydrogenation of at least a portion of the unsaturated compounds contained in the feed, containing at most six carbon atoms per molecule, i.e., containing up to six (inclusive) carbon atoms per molecule, is carried out in the presence of a hydrogenation catalyst and a gas stream comprising hydrogen, preferably in the major portion, the feed for the reaction zone being drawn off from the height of a draw-off level and representing at least a portion, preferably the major portion, of the liquid flowing in the distillation zone, at least a portion, preferably the major portion, of the effluent from the reaction zone being re-introduced into the distillation zone at a height of at least one re-introduction level, so as to ensure continuity of distillation, and so that a distillate which is highly depleted in unsaturated compounds is recovered, said process being characterized in that the temperature of the portion of the effluent from the reaction zone re-introduced into the distillation zone is lower than that of the feed for the hydrogenation reaction zone drawn off at the height of a draw-off level located beneath that reintroduction level.

Application of the process of the invention to the hydrogenation of benzene and other unsaturated compounds can produce, from a crude reformate, a reformate which is depleted in benzene or, if required, almost free of benzene and other unsaturated hydrocarbons containing at most six carbon atoms per molecule, such as light olefins.

The process of the invention can reduce the reflux ratio (the ratio of the mass flow rate of the reflux measured at the column head to the mass flow rate of the supply to the distillation zone) of the distillation zone and thus obtain a reduction in the size of the distillation zone with an equal or better hydrocarbon conversion to that obtained with prior art processes. Further, the process of the present invention can reduce the total heat exchange surface area necessary compared with prior art processes. The process of the invention is characterized by the creation of an intermediate circulating reflux. This circulating reflux is created by re-introducing at least one liquid to a re-introduction level located above the draw-off level at a temperature which is lower than the temperature of said liquid at the level at which it is drawn off from the distillation zone.

Thus the liquid drawn off from the distillation zone is cooled and the liquid is re-introduced at a temperature which is lower than the temperature of said liquid at the draw-off level in order to create a circulating reflux in the distillation zone.

The liquid which acts as the feed for the reaction zone is the liquid drawn off from the distillation zone at a draw-off level and re-introduced at a re-introduction level located above said draw-off level, the temperature of said liquid at the re-introduction level being lower than the temperature of said liquid at the draw-off level.

Cooling can be carried out before the feed enters the reaction zone or at the outlet from the reaction zone before re-introduction into the distillation zone.

Preferably, the temperature of the liquid at the re-introduction level is lower by at least 10° C., preferably at least 15° C. and more preferably at least 18° C. than the temperature of said liquid at the draw-off level from the distillation zone.

The level for re-introducing the effluent from the external reaction zone is generally located substantially below or substantially above or substantially at the same height of at least one draw-off level, preferably said level for drawing off the feed to be converted. When drawing off for the reaction zone to establish the circulating reflux by cooling the feed or the effluent from the reaction zone, the re-introduction level is located above the draw-off level.

In a preferred implementation, the re-introduction level is located at least 2 theoretical plates above the draw-off level and more preferably, the re-introduction level for the feed is located at least 4 theoretical plates above the draw-off level for the feed.

The distillation zone generally comprises at least one column provided with at least one distillation contact means selected from the group formed by plates, bulk packing and structured packing, as is well known to the skilled person, such that the total global efficiency is equal to at least five theoretical plates. In cases known to the skilled person where using a single column can cause problems, it is preferable to split the zone and use two columns which, placed end to end, produce said zone.

The feed is introduced into the distillation zone at at least one introduction level located below the level for drawing off liquid towards the reaction zone, generally at a level of 10 to 40 theoretical plates and preferably 15 to 25 theoretical plates below the level for drawing off liquid towards the reaction zone, the draw-off level under consideration being the lowest.

The reaction zone generally comprises at least one catalytic hydrogenation bed, preferably 1 to 4 catalytic bed(s); when at least two catalytic beds are incorporated into the distillation zone, these two beds may be separated by at least one distillation contact means.

In the particular application of the process of the invention to reducing the benzene content in a hydrocarbon cut, the hydrogenation reaction zone carries out at least partial hydrogenation of benzene present in the feed, generally such that the benzene content in the liquid distillate is a maximum of a certain value, and said reaction zone hydrogenates at least part, preferably the major part, of any unsaturated compound containing at most six carbon atoms per molecule and other than benzene which may be present in the feed.

The reaction zone is at least partially external to the distillation zone. Generally, the process of the invention includes 1 to 6, preferably 1 to 4 draw-off level(s) which supply the external portion of the zone. A portion of the external portion of the reaction zone which is supplied by a given draw-off level, if the external portion of the reaction zone comprises at least two draw-off levels, generally comprises at least one reactor, preferably a single reactor.

The circulating reflux from the distillation zone created by cooling at least one circulating liquid drawn off from the distillation zone and re-introduced at a lower temperature is produced by using at least one cooling means, for example at least one heat exchanger.

Since the reactor is at least partially external, a flow of liquid is drawn off which is equal to, greater than or less than the liquid traffic in the distillation zone located below the draw-off level for the feed to be converted.

In the particular case of reducing the benzene content in a hydrocarbon cut, the flow rate of the drawn off liquid depends on the feed. For feeds with a rather high benzene content, for example over 3% by volume, the flow rate of drawn liquid off is preferably equal to or greater than the liquid traffic in the distillation zone located below the draw-off level.

For feeds with a rather low benzene content, for example a content of less than about 3% by volume, the flow rate of the drawn off liquid is preferably equal to or less than the liquid traffic in the distillation zone located beneath the draw-off level.

The process of the invention can convert a large portion of the compound(s) to be converted external to the distillation zone, possibly under absolute pressure and/or temperature conditions which are different from those used in the distillation zone. Further, conversion in a reaction zone which is at least partially external to the distillation zone can create a circulating reflux in the distillation zone, by cooling the liquid drawn off from the distillation zone for external conversion.

The process of the invention is such that the flow of liquid to be converted is generally co-current to the flow of the gas stream comprising hydrogen for all catalytic beds in the external portion of the reaction zone.

In a preferred implementation of the process of the invention, the reaction zone is completely external to the distillation zone. When the external portion of the reaction zone comprises at least two catalytic beds, each catalytic bed is supplied by a single draw-off level, preferably associated with a single re-introduction level, said draw-off level being distinct from the draw-off level which supplies the other catalytic bed(s).

In one implementation of the invention, the liquid distillate is directly recovered by withdrawal from the distillation zone. This implementation is effected by dissociating the level from which the liquid distillate is withdrawn from the level from which the gaseous distillate is recovered, the liquid distillate being withdrawn from at least one withdrawal level beneath that for recovering the vapour distillate. Thus the desired product is withdrawn as a stabilised liquid distillate. When hydrogenating benzene, the stabilised liquid distillate is free of the major portion of the excess hydrogen and light gases comprising essentially hydrocarbons containing at most 5 carbon atoms and a very small quantity of heavier hydrocarbons. Further, such distinct vapour distillate recovery can eliminate gases other than the hydrogen present in the gas stream comprising for the most part hydrogen introduced to carry out the conversion reaction via the gaseous distillate. The level for withdrawal of the stabilised liquid distillate is generally located above or below or substantially at the same height as at least one level for re-introducing the at least partially converted feed from the external reaction zone.

In order to carry out hydrogenation using a particular application of the process of the invention, the theoretical mole ratio of hydrogen necessary for the desired conversion of benzene is 3. The quantity of hydrogen distributed upstream of or in the hydrogenation zone is optionally in excess with respect to this stoichiometry, and this must be higher when, in addition to the benzene in the feed, any unsaturated compound containing at least six carbon atoms per molecule present in said feed must be at least partially hydrogenated.

In general, the excess hydrogen, if any, can advantageously be recovered for example using one of the techniques described below. In a first technique, the excess hydrogen leaving the reaction zone is recovered either directly at the level of the effluent at the outlet from the reaction zone, or in the gaseous distillate from the distillation zone, then compressed and re-used in said reaction zone to create a reflux. In a second technique, the excess hydrogen which leaves the reaction zone is recovered, then injected upstream of the compression steps associated with a catalytic reforming unit, mixed with hydrogen from said unit, said unit preferably operating at low pressure, i.e. generally at an absolute pressure of less than 0.8 MPa.

The hydrogen included in the gas stream used, for example, in the particular process of the invention for hydrogenating unsaturated compounds containing at most six carbon atoms per molecule, can originate from any source producing at least 50% by volume pure hydrogen, preferably at least 80% by volume pure hydrogen and more preferably at least 90% pure hydrogen. As an example, the hydrogen from catalytic reforming processes, methanation, PSA (pressure swing adsorption), electrochemical generation or steam cracking can be cited.

One preferred implementation of the process of the invention, which may or may not be independent of the preceding implementations, is such that the effluent from the bottom of the distillation zone is at least partially mixed with the liquid distillate. When hydrogenating benzene in a hydrocarbon cut, the mixture obtained can be used as a fuel either directly, or by incorporation into fuel fractions.

When the reaction zone is partially internal to the distillation zone, the operating conditions for the portion of the reaction zone internal to the distillation zone are linked to the operating conditions for the distillation step. Distillation is carried out at an absolute pressure which is generally in the range 0.1 MPa to 2.5 MPa with a reflux ratio in the range 0.1 to 20. The temperature in the distillation zone is in the range 10° C. to 300° C. In general, the liquid to be converted is mixed with a gas stream comprising hydrogen the flow rate of which is at least equal to the stoichiometry of the conversion reactions carried out and is at most equal to the flow rate corresponding to 10 times the stoichiometry. In the external portion of the reaction zone, the catalyst is located in every catalytic bed using any technology which is known to the skilled person under operating conditions (temperature, pressure, . . . ) which may or may not be independent, preferably independent, of the operating conditions of the distillation zone. In the portion of the reaction zone external to the distillation zone, the operating conditions are generally as follows. The absolute pressure required is generally in the range 0.1 to 6 MPa. The operating temperature is generally in the range 30° C. to 400° C. The space velocity in said reaction zone, calculated with respect to the catalyst, is generally in the range 0.5 to 60 $h^{-1}$. The flow rate of hydrogen corresponding to the stoichiometry of the conversion reactions carried out is in the range 1 to 10 times said stoichiometry.

In the particular case of reducing the benzene content in a hydrocarbon cut, the operating conditions are as follows. When the hydrogenation zone is partially internal to the distillation zone, the operating conditions for the portion of the hydrogenation zone internal to the distillation zone are linked to the operating conditions for the distillation step. Distillation is carried out at an absolute pressure generally in the range 0.2 to 2 MPa, preferably in the range 0.4 to 1 MPa, with a reflux ratio in the range 0.1 to 10, preferably in the range 0.2 to 1. The temperature at the head of the zone is generally in the range 30° C. to 180° C. and the temperature at the bottom of the zone is generally in the range 120° C. to 280° C. The hydrogenation reaction is carried out under conditions which are most generally intermediate between those established at the head and at the bottom of the distillation zone, at a temperature in the range 100° C. to 200° C., preferably in the range 120° C. to 180° C., and at an absolute pressure in the range 0.2 to 3 MPa, preferably in the range 0.4 to 2 MPa. The liquid undergoing hydrogenation is mixed with a gas stream comprising hydrogen the flow rate of which depends on the concentration of benzene in said liquid and, more generally, on the concentration of the unsaturated compounds containing at most six carbon atoms per molecule in the feed from the distillation zone. The hydrogen flow rate is generally at least equal to the flow rate corresponding to the stoichiometry of the hydrogenation reactions carried out (hydrogenation of benzene and other unsaturated compounds containing at most six carbon atoms per molecule, in the hydrogenation feed) and at most equal to the flow rate corresponding to 10 times the stoichiometry, preferably in the range 1 to 6 times the stoichiometry, more preferably in the range 1 to 3 times the stoichiometry. In the portion of the hydrogenation zone external to the distillation zone, the operating conditions are generally as follows. The absolute pressure required for this hydrogenation step is generally in the range 0.1 to 6 MPa absolute, preferably in the range 0.2 to 5 MPa and more preferably in the range 0.5 to 3.5 MPa. The operating temperature in the hydrogenation zone is generally in the range 100° C. to 400° C. preferably in the range 120° C. to 350° C. and more preferably in the range 140° C. to 320° C. The space velocity in said hydrogenation zone, calculated with respect to the catalyst, is generally in the range 1 to 60 and more particularly in the range 1 to 40 $h^{-1}$ (volume flow rate of feed per volume of catalyst). The hydrogen flow rate corresponding to the stoichiometry of the hydrogenation reactions carried out is in the range 1 to 10 times said stoichiometry, preferably in the range 1 to 6 times said stoichiometry and more preferably in the range 1 to 3 times said stoichiometry. However, the temperature and pressure conditions can also be comprised between those which are established at the head and at the bottom of the distillation zone in the process of the present invention.

In the context of the present description, the term "reflux ratio" means the ratio of the mass flow rate of the reflux measured at the column head over the mass flow rate of the supply to the column.

In the particular case when the reaction zone is a zone for hydrogenating benzene and possible olefins, the catalyst used in the hydrogenation zone generally comprises at least one metal selected from group VIII, preferably selected from the group formed by nickel and platinum, used as it is or, preferably, deposited on a support. At least 50% of the metal must generally be in its reduced form. However, any other hydrogenation catalyst which is known to the skilled person can also be used.

When using nickel, the proportion of nickel with respect to the total catalyst weight is in the range 5% to 70%, more particularly in the range 10% to 70%, and preferably in the range 15% to 65%. Further, the average nickel crystallite size in the catalyst is less than $100\times10^{-10}$ m, preferably less than $80\times10^{-10}$ m, more preferably less than $60\times10^{-10}$ m.

The support is generally selected from the group formed by alumina, silica-aluminas, silica, zeolites, activated charcoal, clays, aluminous cements, rare earth oxides and alkaline-earth oxides, used alone or as a mixture. Preferably, a support based on alumina or silica is used, with a specific surface area in the range 30 to 300 $m^2/g$, preferably in the range 90 to 260 $m^2/g$.

Figure 2:
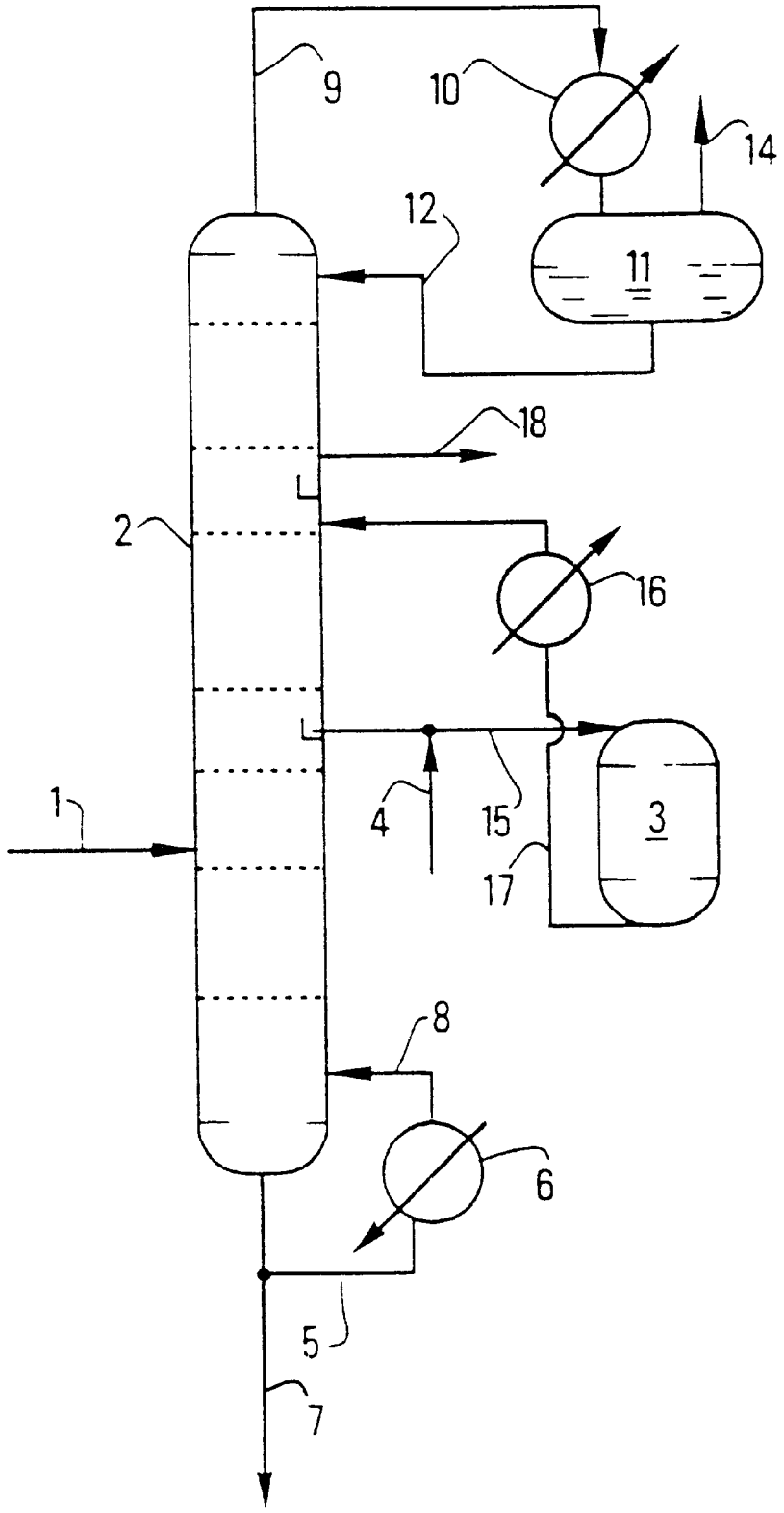

FIGS. 1 and 2 each constitute an illustration of an implementation of the process of the invention. Similar means are represented by the same numerals in each Figure.

FIG. 1 shows a first implementation of the process. The hydrocarbon feed is sent to a column 2 via a line 1. Said column contains distillation contact means, which in the case shown in FIG. 1 are plates or packing, partially represented by dotted lines.

At the foot of the column, the least volatile fraction of the reformate is recovered via a line 5, a portion is reboiled in exchanger 6 and a portion is evacuated via a line 7. The reboiling vapour is re-introduced into the column via a line 8. At the column head, a light hydrocarbon vapour is sent via a line 9 to a condenser 10 then to a drum 11 which separates it into a liquid phase and a vapour phase principally constituted by hydrogen which may be in excess. The vapour phase is evacuated via a line 14. A portion of the liquid phase from drum 11 is returned via a line 12 to the head of the column as a reflux, while a further portion constituting the liquid distillate is evacuated via a line 13.

A liquid is drawn off via a line 15 by means of a draw-off plate located in the distillation zone, and the liquid is sent to the head of a reactor 3, after adding hydrogen via a line 4. The effluent from the reactor is cooled in exchanger 16 then recycled to the column via a line 17.

In a second implementation of the process, shown in FIG. 2, the process is the same as that described for FIG. 1, the only difference being that the stabilised liquid distillate is directly withdrawn from the column via line 18 and no longer via line 13.

EXAMPLES

The following Examples illustrate a particular application of the invention, i.e., selective reduction of benzene in a hydrocarbon cut. They were carried out by simulation using PRO/II® software from Simulation Sciences Incorporated.

Example 1 (comparative)

The unit was that shown in FIG. 1 with no cooling after the hydrogenation reactor.

A metallic distillation column with a diameter of 3.81 m was used; the column comprised, from head to bottom, 45 theoretical plates which were numbered from top to bottom (including the condenser and reboiler).

The reboiling duty was 15660 kw.

The absolute pressure in the reflux drum was 0.5 MPa.

The reflux ratio was 0.82.

The mole ratio of hydrogen to benzene was 2.74.

The hydrogenation reaction was completely external and a reactor located external to the distillation column containing 12 $m^3$ of nickel catalyst sold by PROCATALYSE under the trade name LD746 was used.

The feed for the column was injected into plate 33 via line 1. The feed for reactor 3 was drawn off from plate 12 via line 15 at a temperature of 150° C. Hydrogen was introduced via line 4 before entering the reactor operating in downflow mode and at 1.5 MPa absolute pressure. The effluent from reactor 3 was re-injected into the column into plate 8 via line 17 at a temperature of 182° C. The liquid distillate depleted in unsaturated compounds was withdrawn from the column head.

The simulated compositions of the light reformate fraction (13), purge gas (14) and heavy reformate (7) are shown in Table 1.

The process performances are shown in Table 5.

Example 2 (in accordance with the invention)

The unit of Example 2 was that shown in FIG. 1 accompanying the present text and comprised a means for cooling the hydrocarbon feed in the external reactor.

A metallic distillation column with a diameter of 3.50 m was used; the column comprised, from head to bottom, 45 theoretical plates which were numbered from top to bottom (including the condenser and reboiler).

The reboiling duty was 15660 kw.

The absolute pressure in the reflux drum was 0.5 MPa.

The reflux ratio was 0.40.

The mole ratio of hydrogen to benzene was 2.84.

The hydrogenation reaction was completely external and a reactor located external to the distillation column containing 12 $m^3$ of nickel catalyst sold by PROCATALYSE under the trade name LD746 was used.

The feed for the column was injected into plate 33 via line 1. The feed for reactor 3 was drawn off from plate 12 via line 15 at a temperature of 148° C. Hydrogen was introduced via line 4 before entering the reactor operating in downflow mode and at 1.5 MPa absolute pressure. The effluent from reactor 3 passed into a chiller 16 and was then re-injected into the column into plate 8 via line 17 at a temperature of 115° C. The liquid distillate depleted in unsaturated compounds was withdrawn from the column head.

The simulated compositions of the light reformate fraction (13), purge gas (14) and heavy reformate (7) are shown in Table 2.

The process performances are shown in Table 5.

Example 3 (comparative)

The process configuration included withdrawal of a stabilised liquid distillate below recovery of a vapour distillate but with no circulating reflux. The unit is shown in FIG. 2, but the hydrogenated feed was not cooled.

A metallic distillation column with a diameter of 3.35 m was used; the column comprised, from head to bottom, 45 theoretical plates which were numbered from top to bottom (including the condenser and reboiler).

The reboiling duty was 12350 kw.

The absolute pressure in the reflux drum was 0.5 MPa.

The reflux ratio was 0.92.

The mole ratio of hydrogen to benzene was 2.91.

The exchange surface area of the condenser at the head of distillation zone 10 was 1510 $m^2$.

The hydrogenation reaction was completely external and a reactor located external to the distillation column containing 20.4 $m^3$ of nickel catalyst sold by PROCATALYSE under the trade name LD746 was used.

The feed for the column was injected into plate 33 via line 1. The feed for reactor 3 was drawn off from plate 12 via line 15 at a temperature of 133° C. Hydrogen was introduced via line 4 before entering the reactor operating in downflow mode and at 1.5 MPa absolute pressure. The effluent from reactor 3 was re-injected into the column into plate 8 via line 17 at a temperature of 167° C. The liquid distillate depleted in unsaturated compounds was withdrawn from plate 6.

The simulated compositions of the light reformate fraction (18), purge gas (14) and heavy reformate (7) are shown in Table 3.

The process performances are shown in Table 5.

Example 4 (in accordance with the invention)

The unit shown in FIG. 2 comprised a system for cooling the effluent from the hydrogenation zone.

A metallic distillation column with a diameter of 3.05 m was used; the column comprised, from head to bottom, 45 theoretical plates which were numbered from top to bottom (including the condenser and reboiler).

The reboiling duty was 12350 kw.

The absolute pressure in the reflux drum was 0.5 MPa.

The reflux ratio was 0.23.

The mole ratio of hydrogen to benzene was 2.91.

The heat exchange surface area of the condenser at the head of distillation zone 10 was 385 $m^2$ and the surface area of the exchanger located after reaction zone 16 was 406 $m^2$.

The hydrogenation reaction was completely external and a reactor located external to the distillation column containing 20.4 $m^3$ of nickel catalyst sold by PROCATALYSE under the trade name LD746 was used.

The feed for the column was injected into plate 33 via line 1. The feed for reactor 3 was drawn off from plate 12 via line 15 at a temperature of 132° C. Hydrogen was introduced via line 4 before entering the reactor operating in downflow mode and at 1.5 MPa absolute pressure. The effluent from reactor 3 cooled in chiller 16, was re-injected into the column into plate 8 via line 17 at a temperature of 114° C. The liquid distillate depleted in unsaturated compounds was withdrawn from plate 6.

The simulated compositions of the light reformate fraction (18), purge gas (14) and heavy reformate (7) are shown in Table 4.

The process performances are shown in Table 5.

Example 5

The performances of the processes described in Examples 1 to 4 are summarised in Table 5.

The process of the invention as described in Examples 2 and 4, with a benzene conversion equal to or greater than that of prior art processes as described in Examples 1 and 2, substantially reduced the reflux ratio in the column with a consequent reduction in the column size (diameter).

Example 2 shows that the process of the invention can obtain a benzene conversion which is greater than that obtained with the implementation of Example 1.

Example 4 shows that the exchange surface area required was lower in the process of the present invention than that which had to be used in the case of the implementation of Example 3.

Finally, the process of the present invention enabled a column with a lower circumference than those of the prior art to be used.

Compared with the operating mode described in Examples 1 and 2, adding the stabilisation zone as described in Example 4 improved the performances in terms of eliminating benzene and the reboiling duty.

TABLE 1

Composition and flow rate of feed and effluents for Example 1

| Substance/Kmoles/h | Feed | $H_2$ | Gas purge | Light reformate | Heavy reformate |
|---|---|---|---|---|---|
| $H_2$ | 0.00 | 210.52 | 9.32 | 1.00 | 0.00 |
| Methane | 0.00 | 8.07 | 5.33 | 2.74 | 0.00 |
| Ethane | 0.00 | 6.46 | 2.15 | 4.31 | 0.00 |
| Propane | 0.00 | 3.69 | 0.45 | 3.24 | 0.00 |

TABLE 1-continued

Composition and flow rate of feed and effluents for Example 1

| Substance/Kmoles/h | Feed | $H_2$ | Gas purge | Light reformate | Heavy reformate |
|---|---|---|---|---|---|
| Butanes | 18.00 | 1.84 | 0.91 | 18.93 | 0.00 |
| Iso-pentanes | 63.54 | | 1.48 | 62.05 | 0.00 |
| Normal pentanes | 46.43 | | 0.88 | 46.36 | 0.00 |
| Dimethylbutanes | 18.50 | | 0.19 | 18.31 | 0.00 |
| Other C6 paraffins | 109.27 | | 0.82 | 111.10 | 0.02 |
| C7 paraffins | 60.75 | | 0.10 | 34.06 | 27.00 |
| C8 paraffins | 7.46 | | 0.00 | 0.00 | 7.46 |
| C9 + paraffins | 3.47 | | 0.00 | 0.00 | 3.47 |
| Cyclopentane | 2.99 | | 0.04 | 2.95 | 0.00 |
| Methylcyclopentane | 5.00 | | 0.03 | 4.95 | 0.03 |
| Cyclohexane | 0.83 | | 0.27 | 64.11 | 0.18 |
| Methylcyclohexane | 4.50 | | 0.00 | 0.05 | 6.17 |
| C8 naphthenes | 0.62 | | 0.00 | 0.00 | 0.62 |
| Pentenes | 2.37 | | 0.04 | 1.51 | 0.00 |
| Hexenes | 3.32 | | 0.01 | 0.65 | 0.00 |
| Heptenes | 1.60 | | 0.00 | 0.00 | 1.17 |
| Benzene | 76.77 | | 0.06 | 9.51 | 3.50 |
| Toluene | 331.01 | | 0.00 | 0.00 | 329.29 |
| C8 aromatics | 371.99 | | 0.00 | 0.00 | 371.99 |
| C9 aromatics | 165.74 | | 0.00 | 0.00 | 165.74 |
| C10 aromatics | 24.49 | | 0.00 | 0.00 | 24.49 |
| TOTAL kmol/h | 1318.64 | 230.58 | 22.08 | 385.83 | 941.11 |

TABLE 2

Composition and flow rate of feed and effluents for Example 2

| Substance/Kmoles/h | Feed | $H_2$ | Gas purge | Light reformate | Heavy reformate |
|---|---|---|---|---|---|
| $H_2$ | 0.00 | 218.24 | 10.41 | 1.02 | 0.00 |
| Methane | 0.00 | 8.37 | 5.71 | 2.66 | 0.00 |
| Ethane | 0.00 | 6.69 | 2.38 | 4.31 | 0.00 |
| Propane | 0.00 | 3.82 | 0.51 | 3.32 | 0.00 |
| Butanes | 18.00 | 1.91 | 1.00 | 18.91 | 0.00 |
| Iso-pentanes | 63.54 | | 1.63 | 61.91 | 0.00 |
| Normal pentanes | 46.43 | | 0.97 | 46.32 | 0.00 |
| Dimethylbutanes | 18.50 | | 0.21 | 18.29 | 0.00 |
| Other C6 paraffins | 109.27 | | 0.90 | 111.17 | 0.02 |
| C7 paraffins | 60.75 | | 0.11 | 34.24 | 26.80 |
| C8 paraffins | 7.46 | | 0.00 | 0.00 | 7.46 |
| C9 + paraffins | 3.47 | | 0.00 | 0.00 | 3.47 |
| Cyclopentane | 2.99 | | 0.04 | 2.95 | 0.00 |
| Methylcyclopentane | 5.00 | | 0.03 | 4.95 | 0.03 |
| Cyclohexane | 0.83 | | 0.31 | 66.42 | 0.19 |
| Methylcyclohexane | 4.50 | | 0.00 | 0.06 | 5.93 |
| C8 naphthenes | 0.62 | | 0.00 | 0.00 | 0.62 |
| Pentenes | 2.37 | | 0.04 | 1.46 | 0.00 |
| Hexenes | 3.32 | | 0.00 | 0.49 | 0.00 |
| Heptenes | 1.60 | | 0.00 | 0.00 | 1.17 |
| Benzene | 76.77 | | 0.05 | 7.15 | 3.5 |
| Toluene | 331.01 | | 0.00 | 0.00 | 329.52 |
| C8 aromatics | 371.99 | | 0.00 | 0.00 | 371.99 |
| C9 aromatics | 165.74 | | 0.00 | 0.00 | 165.74 |
| C10 aromatics | 24.49 | | 0.00 | 0.00 | 24.49 |
| TOTAL | 1318.64 | 239.04 | 24.32 | 385.62 | 940.93 |

TABLE 3

Composition and flow rate of feed and effluents for Example 3

| Substance/Kmoles/h | Feed | $H_2$ | Gas purge | Light reformate | Heavy reformate |
|---|---|---|---|---|---|
| $H_2$ | 0.00 | 223.86 | 10.17 | 0.00 | 0.00 |
| Methane | 0.00 | 8.58 | 8.58 | 0.00 | 0.00 |
| Ethane | 0.00 | 6.87 | 6.87 | 0.00 | 0.00 |
| Propane | 0.00 | 3.92 | 3.90 | 0.02 | 0.00 |
| Butanes | 18.00 | 1.96 | 15.79 | 4.16 | 0.00 |
| Iso-pentanes | 63.54 | | 5.67 | 57.87 | 0.00 |
| Normal pentanes | 46.43 | | 1.91 | 46.37 | 0.00 |
| Dimethylbutanes | 18.50 | | 0.05 | 18.45 | 0.00 |
| Other C6 paraffins | 109.27 | | 0.07 | 112.47 | 0.03 |
| C7 paraffins | 60.75 | | 0.00 | 41.97 | 19.33 |
| C8 paraffins | 7.46 | | 0.00 | 0.00 | 7.46 |
| C9 + paraffins | 3.47 | | 0.00 | 0.00 | 3.47 |
| Cyclopentane | 2.99 | | 0.02 | 2.97 | 0.00 |
| Methylcyclopentane | 5.00 | | 0.00 | 4.96 | 0.04 |
| Cyclohexane | 0.83 | | 0.00 | 69.24 | 0.12 |
| Methylcyclohexane | 4.50 | | 0.00 | 0.44 | 4.85 |
| C8 naphthenes | 0.62 | | 0.00 | 0.00 | 0.62 |
| Pentenes | 2.37 | | 0.04 | 0.47 | 0.00 |
| Hexenes | 3.32 | | 0.00 | 0.01 | 0.00 |
| Heptenes | 1.60 | | 0.00 | 0.01 | 1.05 |
| Benzene | 76.77 | | 0.00 | 1.15 | 7.09 |
| Toluene | 331.01 | | 0.00 | 0.01 | 330.22 |
| C8 aromatics | 371.99 | | 0.00 | 0.00 | 371.99 |
| C9 aromatics | 165.74 | | 0.00 | 0.00 | 165.74 |
| C10 aromatics | 24.49 | | 0.00 | 0.00 | 24.49 |
| TOTAL kmol/h | 1318.64 | 245.20 | 53.08 | 360.58 | 936.48 |

TABLE 4

Composition and flow rate of feed and effluents for Example 4

| Substance/Kmoles/h | Feed | $H_2$ | Gas purge | Light reformate | Heavy reformate |
|---|---|---|---|---|---|
| $H_2$ | 0.00 | 223.67 | 9.94 | 0.00 | 0.00 |
| Methane | 0.00 | 8.57 | 8.56 | 0.01 | 0.00 |
| Ethane | 0.00 | 6.86 | 6.83 | 0.03 | 0.00 |
| Propane | 0.00 | 3.92 | 3.80 | 0.12 | 0.00 |
| Butanes | 18.00 | 1.96 | 14.04 | 5.92 | 0.00 |
| Iso-pentanes | 63.54 | | 5.71 | 57.83 | 0.00 |
| Normal pentanes | 46.43 | | 1.94 | 46.35 | 0.00 |
| Dimethylbutanes | 18.50 | | 0.05 | 18.45 | 0.00 |
| Other C6 paraffins | 109.27 | | 0.08 | 112.46 | 0.03 |
| C7 paraffins | 60.75 | | 0.00 | 41.93 | 19.36 |
| C8 paraffins | 7.46 | | 0.00 | 0.00 | 7.46 |
| C9 + paraffins | 3.47 | | 0.00 | 0.00 | 3.47 |
| Cyclopentane | 2.99 | | 0.02 | 2.97 | 0.00 |
| Methylcyclopentane | 5.00 | | 0.00 | 4.96 | 0.04 |
| Cyclohexane | 0.83 | | 0.00 | 69.27 | 0.12 |
| Methylcyclohexane | 4.50 | | 0.00 | 0.44 | 4.84 |
| C8 naphthenes | 0.62 | | 0.00 | 0.00 | 0.62 |
| Pentenes | 2.37 | | 0.04 | 0.46 | 0.00 |
| Hexenes | 3.32 | | 0.00 | 0.01 | 0.00 |
| Heptenes | 1.60 | | 0.00 | 0.01 | 1.05 |
| Benzene | 76.77 | | 0.00 | 1.13 | 7.09 |
| Toluene | 331.01 | | 0.00 | 0.01 | 330.22 |
| C8 aromatics | 371.99 | | 0.00 | 0.00 | 371.99 |
| C9 aromatics | 165.74 | | 0.00 | 0.00 | 165.74 |
| C10 aromatics | 24.49 | | 0.00 | 0.00 | 24.49 |
| TOTAL kmol/h | 1318.64 | 244.99 | 51.01 | 362.35 | 936.53 |

TABLE 5

| Performances of processes | | |
|---|---|---|
| Example | 1 | 2 |
| RVP MPa | 0.41 | 0.41 |
| Benzene, vol % | 0.71 | 0.59 |
| Q reboiling kw | 15660 | 15660 |
| Catalyst volume $m^3$ | 12 | 12 |
| Reflux ratio | 0.82 | 0.40 |
| Column diameter m | 3.81 | 3.50 |
| Example | 3 | 4 |
| RVP MPa | 0.06 | 0.06 |
| Benzene, vol % | 0.46 | 0.46 |
| Q reboiling kw | 12350 | 12350 |
| Catalyst volume $m^3$ | 20.4 | 20.4 |
| Heat exchange surface area $m^2$ | 1510 | 791 |
| Reflux ratio | 0.92 | 0.23 |
| Column diameter m | 3.35 | 3.05 |

The preceding examples can be repeated with similar success by substituting the generically or specifically described reactants and/or operating conditions of this invention for those used in the preceding examples. Also, the preceding specific embodiments arc to be construed as merely illustrative, and not limitative of the remainder of the disclosure in any way whatsoever.

The entire disclosure of all applications, patents and publications, cited above and below, and of corresponding French application 98/04.352, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for converting a hydrocarbon feed in which said feed is treated in a distillation zone having a bottom and top producing respectively a bottom effluent and a vapour distillate, associated with an at least partially external reaction zone comprising at least one catalytic bed, in which at least one reaction for converting at least a portion of at least one hydrocarbon is carried out in the presence of a catalyst and a gas stream comprising hydrogen, the feed for the external reaction zone being drawn off at the height of at least one draw-off level as a side stream below the top of the distillation zone and representing at least a portion of the liquid flowing in the distillation zone, at least part of the effluent from the external reaction zone being re-introduced into the distillation zone at the height of at least one re-introduction level below the top of the distillation zone, so as to ensure continuity of the distillation, said process being characterized in that the temperature of the portion of effluent from the external reaction zone re-introduced into the distillation zone is lower than that of the feed for the reaction zone drawn off at the height of the draw-off level, and said draw-off level is located below the re-introduction level.

2. A process according to claim 1, in which the portion of the effluent re-introduced into the distillation zone is brought to a temperature which is lower by at least 10° C. than the temperature of the feed for the reaction zone drawn off from the height of the draw-off level located below the re-introduction level.

3. A process according to claim 1, comprising a single level for drawing off feed for the reaction zone.

4. A process according to claim 1, in which the level for re-introducing the effluent from the reaction zone is at least the second theoretical plate above the level for drawing off feed for the reaction zone.

5. A process according to claim 1, further comprising withdrawing a sidestream distillate in liquid and stabilised form from the height of at least one withdrawal level located below the top of the distillation zone where said vapour distillate is withdrawn and above the level for drawing off the sidestream feed for the reaction zone.

6. A process according to claim 1, in which the reaction zone is completely external to the distillation zone.

7. A process according to claim 1, in which distillation is carried out at an absolute pressure in the range 0.1 to 2.5 MPa with a reflux ratio in the range 0.1 to 20 and at a temperature in the range 10° C. to 300° C.

8. A process according to claim 1, in which for the portion of the conversion reaction external to the distillation zone, the absolute pressure required for this conversion step is in the range 0.1 to 6 MPa, the temperature is in the range 30° C. to 400° C., the space velocity in the conversion zone, calculated with respect to the catalyst, is in the range 0.5 to 60 $h^{-1}$ (volume of feed per volume of catalyst per hour) and the hydrogen flow rate is in the range one to ten times the flow rate corresponding to the stoichiometry of the conversion reactions carried out.

9. A process according to claim 1, in which said feed comprises a major portion of hydrocarbons comprising at least 5 carbon atoms per molecule said hydrocarbons comprising at least one unsaturated compound said at least one unsaturated compound comprising benzene and optionally at least one olefin.

10. A process according to claim 9, in which the reaction zone is a hydrogenation zone, in which at least a portion of unsaturated compounds containing at most six carbon atoms per molecule and contained in the feed is hydrogenated in the presence of a hydrogenation catalyst.

11. A process according to claim 9, in which distillation is carried out at an absolute pressure in the range 0.2 to 2 MPa, with a reflux ratio in the range 0.1 to 10, the temperature at the head of the distillation zone being in the range 30° C. to 180° C. and the temperature at the bottom of the distillation zone being in the range 120° C. to 280° C.

12. A process according to claim 9 in which, for the portion of the hydrogenation reaction external to the distillation zone, the absolute pressure required for the hydrogenation step is in the range 0.1 to 6 MPa, the temperature is in the range 100° C. to 400° C., the space velocity in the hydrogenation zone, calculated with respect to the catalyst, is in the range 1 to 60 $h^{-1}$ (volume of feed per volume of catalyst per hour), and the hydrogen flow rate is in the range one to ten times the flow rate corresponding to the stoichiometry of the hydrogenation reactions carried out.

13. A process according to claim 9, in which, a portion of the hydrogenation reaction is conducted internal to the distillation zone wherein the hydrogenation step is carried out at a temperature of 100° C. to 200° C., at an absolute pressure in the range 0.2 to 3 MPa, and the hydrogen flow rate supplying the hydrogenation zone is in the range one to ten times the flow rate corresponding to the stoichiometry of the hydrogenation reactions carried out.

14. A process according to of claim 9, in which the catalyst used in the hydrogenation zone comprises at least one metal selected from the group formed by consisting of nickel and platinum.

15. A process according to claim 1, wherein the effluent from the external reaction zone is reintroduced into the distillation zone without any intervening separation of said effluent.

16. A process according to claim 15, wherein said effluent from the external reaction zone is cooled prior to being directly reintroduced into the distillation zone.

17. A process according to claim 2, wherein the portion of the effluent reintroduced into the distillation zone is brought to a temperature which is lower by at least 18° C. than the temperature of the feed for the reaction zone drawn off from the height of the draw-off level located below the reintroduction level.

18. A process according to claim 1, in which the level for re-introducing the effluent from the reaction zone is at least the fourth theoretical plate above the level for drawing off feed for the reaction zone.

19. A process according to claim 17, in which the level for re-introducing the effluent from the reaction zone is at least the fourth theoretical plate above the level for drawing off feed for the reaction zone.

20. A process according to claim 1, further comprising cooling either the feed for the external reaction zone or the effluent from the external reaction zone.

21. A process according to claim 1, wherein said hydrocarbon feed is introduced into the distillation zone at a level of 10 to 40 theoretical plates below the draw-off level passing liquid to the external reaction zone.

* * * * *